US006382583B1

(12) United States Patent
Hill, III et al.

(10) Patent No.: US 6,382,583 B1
(45) Date of Patent: May 7, 2002

(54) RELEASABLE DEVICE AND METHOD

(75) Inventors: John L. Hill, III, Independent Hill; Joram Shenhar, Fairfax; Stephen G. Solga, Clifton; Donald B. Harris, Arlington, all of VA (US); Eugene L. Foster, deceased, late of Pittsburgh, PA (US), by Carol A. Horowitz, legal representative

(73) Assignee: UTD Incorporated, Manassas, VA (US)

( * ) Notice: Subject to any disclaimer, the term of this patent is extended or adjusted under 35 U.S.C. 154(b) by 0 days.

(21) Appl. No.: 09/551,347

(22) Filed: Apr. 18, 2000

(51) Int. Cl.[7] ..... F16M 13/00

(52) U.S. Cl. ..... 248/548; 248/900; 248/499; 248/545; 403/24; 52/98; 174/40 TD

(58) Field of Search ..... 248/900, 548, 248/499, 308, 500, 545; 403/24, 79, 2; 52/98, 148, 99, 100; 174/40 TD, 40 R

(56) References Cited

U.S. PATENT DOCUMENTS

| | | | | | |
|---|---|---|---|---|---|
| 2,420,267 | A | | 5/1947 | Sefried, II | |
| 3,049,194 | A | * | 8/1962 | Brendel | 189/31.5 |
| 3,349,531 | A | * | 10/1967 | Watson | 52/296 |
| 3,355,998 | A | * | 12/1967 | Roemisch | 94/1.5 |
| 3,504,460 | A | | 4/1970 | Solberg | |
| 3,512,317 | A | | 5/1970 | Lynch | |
| 3,623,286 | A | | 11/1971 | Parduhn | |
| 3,866,367 | A | | 2/1975 | Strizki | |
| 4,079,556 | A | | 3/1978 | Luck et al. | |
| 4,517,913 | A | | 5/1985 | Albertini et al. | |
| 4,528,786 | A | | 7/1985 | Dinitz et al. | |
| 4,610,432 | A | | 9/1986 | Lewis et al. | |
| 4,716,937 | A | * | 1/1988 | Hendrickson | 138/45 |
| 4,720,204 | A | * | 1/1988 | Johnson | 403/24 |
| 4,759,161 | A | | 7/1988 | Kucyk, Jr. et al. | |
| 4,813,199 | A | | 3/1989 | Lewis, Jr. | |
| 4,850,565 | A | * | 7/1989 | Moreno | 248/545 |
| 4,858,802 | A | * | 8/1989 | Hamby et al. | 224/273 |
| 4,858,876 | A | * | 8/1989 | Moreno | 248/545 |
| 4,928,446 | A | | 5/1990 | Alexander, Sr. | |
| 5,125,194 | A | * | 6/1992 | Grnger | 52/98 |
| 5,160,111 | A | | 11/1992 | Hugron | |
| 5,214,886 | A | * | 6/1993 | Hugron | 52/98 |
| 5,474,408 | A | | 12/1995 | Dinitz et al. | |
| 5,480,121 | A | | 1/1996 | Rice et al. | |
| 5,529,276 | A | * | 6/1996 | Szablya | 248/548 |
| 6,245,991 | B1 | * | 6/2001 | Ryan | 174/40 TD |

OTHER PUBLICATIONS

*Safer Timber Utility Poles,* Don L. Ivey et al., Summary Report, vol. 1, Texas Transportation Institute, Sep. 1985, cover and pp. 76–83 and 128–130.

*Roadside Safety and the Breakaway Utility Pole,* James A. Carney, Oct. 19, 1988, pp. 1–21.

*Roadside Design Guide* © 1989, American Association of State Highway and Transportation Officials, Inc., cover and pp. 4–13 and 4–14.

* cited by examiner

*Primary Examiner*—Kimberly T. Wood
(74) *Attorney, Agent, or Firm*—Dickstein Shapiro Morin & Oshinsky LLP

(57) ABSTRACT

A safety device may be used to provide separation in the event of a side impact collision. The device may be used in a utility pole guy wire system, interposed between the guy wire and the ground anchor. The device operates in bending. A lateral force of sufficient magnitude applied to the device by the errant vehicle causes a rod within the device to break in tension, even though the tensile strength of the rod may be greater than that of the guy wire. In operation, certain massive portions of the device are tied safely to the ground, while other portions are pulled over the moving vehicle by the tension of the guy wire. The invention may be designed to tolerate axial loads, but to fail reliably when a side force exceeds a desired threshold. When installed in series with a utility pole guy wire, the invention will withstand all normal tensile and incidental loads, and will release when subjected to a high side force as from an automobile impact.

18 Claims, 5 Drawing Sheets

RELEASABLE DEVICE AND METHOD

This invention was made with government support under Contract No. DTRS57-99-C-00011 awarded by the U.S. Department of Transportation. The government has certain rights in the invention.

FIELD OF THE INVENTION

The present invention relates generally to releasable connectors. More particularly, the present invention relates to a releasable connector for a guy wire system. In addition, the present invention relates to a system for releasing a guy wire from an anchor device in the event of a collision.

BACKGROUND OF THE INVENTION

The United States has between eighty million and one hundred million wooden utility poles along approximately four million miles of public roads. Approximately fifteen hundred to two thousand fatalities and about one hundred thousand injuries occur each year as a result of automotive collisions with utility poles. In an automobile crash with a utility pole guy wire, the car may roll over or it may be thrown into oncoming traffic with disastrous consequences.

Known techniques for reducing the number and/or severity of collisions include: providing lateral separation from the road; placing utility lines underground; shielding poles with guard rails; and providing advanced warning signs, wider shoulders, better lighting, skid resistant pavement, and better roadway alignment. The known techniques are generally too costly and/or too inconvenient for wide-scale implementation, however. Another approach has been to construct the poles in such a way as to reduce the likelihood of injury in the event of a collision. The Federal Highway Administration, for example, has developed a slip base upgrade for utility poles which reduces the likelihood of severe injury in an accident. The problems caused by guy wires, however, have not been satisfactorily resolved in the prior art.

A frangible guy wire device was referred to in "Safer Timber Utility Poles," Volume I, Summary Report, Texas Transportation Institute ("TTI") (September 1986). The device tested by TTI consisted of a six foot length of three-quarters inch galvanized steel pipe. The device relied on stress concentration as the failure mechanism. The stress concentration was formed by a rigid section connecting two pipes. Failure occurs at the pipe threads adjacent to the rigid section. There are several problems associated with the device referred to in the TTI report. One such problem is that stress concentration is not a reliable release mechanism in a guy wire system. It is difficult to control the critical dimensions at the stress concentration point, and corrosion affects the performance characteristics of the device. In addition, the device tested by TTI was unduly sensitive to the bumper height of the colliding vehicle. In particular, the device might fail to release when a car approached from "underneath" the guy wire. In addition, the long pipe itself could create a hazard during a collision, and the device could not be easily rebuilt afterward.

Another known device for a guy wire system is described in U.S. Pat. No. 5,529,276 (Szablya). The Szablya device relies on stress concentration and shock bending stress. As such, it is not sufficiently reliable. The release characteristics of the Szablya device would be dependent on parameters such as surface finish, corrosion, wear and manufacturing tolerances, which may be difficult to control. In general, corrosion is a problem with any outdoor system that relies on stress concentration as a release mechanism. In addition, the parts of the Szablya device that remain with the guy wire after a break could become dangerous moving objects, since they are not tied to the ground. In addition, the Szablya device would be difficult to manufacture, and it would be difficult to rebuild the device after a collision.

SUMMARY OF THE INVENTION

The disadvantages of the prior art are overcome to a great extent by the present invention. The present invention relates to a releasable connector device for providing a separation mechanism in a collision. The device may be formed of at least two elongated rigid elements and a tension member located between the rigid elements. During a side impact collision, the rigid elements pivot to amplify the axial stress applied to the tension member, such that the tension member breaks to provide the desired separation. If desired, a flexible connector or tether may be used to prevent the upper rigid element from separating from the lower element.

In a preferred embodiment of the invention, the rigid elements are steel pipes, and the tension element is a threaded steel rod located within the pipes. The present invention should not be limited, however, to the preferred embodiments shown and described in detail herein.

According to one aspect of the invention, a threaded unit is used to hold the upper pipe to the tension member. The threaded unit may be located within the upper pipe, if desired. The threaded unit may be arranged to slide out of the upper pipe along with the threaded rod during a collision.

According to another aspect of the invention, a threaded fixture is located within the lower pipe for connecting the tension member to the lower pipe.

The present invention also relates to a release system that has a connector device interposed between a guy wire and an anchor device. The connector device may be formed of elongated rigid elements in contact with each other at a break point (or at a separation plane). A flexible element may be used to secure the rigid elements together during a collision. The flexible element, which may be a cable, chain or the like, may be used to tie or tether the upper portion of the connector device to the lower portion of the device, to prevent the upper portion from causing damage and/or injury to the vehicle and/or its occupants.

In a preferred embodiment of the invention, a threaded rod is used as the breakable element in the connector device. When a bending stress is applied to the device, for example during a side impact collision, the threaded rod breaks in tension at a preselected break point. The tension in the guy wire causes the broken portion of the rod to be pulled out of the connector with sufficient force to minimize the possibility that the rod will come into contact with the moving vehicle or its occupants.

According to yet another aspect of the invention, the rigid elements are placed in an end to end relationship and a fulcrum bending point is formed between the rigid elements. During a collision, the device bends or pivots at the fulcrum point. The rigid elements themselves do not bend to the extent that any permanent deformation occurs. As a result, the pipe elements may be used in a rebuilt device, after the collision.

The present invention also relates to a method of operating a guy wire system, particularly during a vehicle collision. In operation, the impact force of the vehicle and tensile force in the guy wire create a bending moment in a connector device. The connector device may be interposed between the guy wire and an anchor device at approximately the height of the oncoming vehicle (i.e., the height of the bumper or other impact point of the vehicle). The bending moment causes a breakable element to break in tension. The tensile strength of the breakable element may be greater than that of the guy wire, if desired. The breakable element is broken because of the mechanical advantage applied by placing the connector device in bending.

As the vehicle (a car, truck, etc.) moves through the original location of the connector device, the guy wire tension causes at least a portion of the breakable element to be pulled through an upper pipe. A flexible connection keeps the upper pipe tied to a lower pipe, to reduce the amount of damage that might otherwise be done by the upper pipe. The tension of the guy wire causes the breakable rod to be cast up and over the moving vehicle. The remainder of the connector device remains anchored to the ground, where the vehicle can run over it.

An object of the invention is to provide a device that fails or releases reliably when subjected to a side force above a design threshold.

Another object of the invention is to provide a system that is actuated by automobiles, trucks and other vehicles, and that operates as intended over a wide range of vehicle speeds.

Another object of the invention is to provide a device that releases upon impact regardless of the direction of travel of the errant vehicle.

Yet another object of the invention is to provide a device that can be used in a wide variety of different size guy wire systems and in a variety of environmental conditions.

Another object of the invention is to provide a connector device that reliably performs a breakaway operation in bending at lateral loads smaller than those that would tend to tip a car over or allow it to ride up a guy wire.

Yet another object of the invention is to provide a low cost connector device that can be easily installed and repaired by utility crews.

In a preferred embodiment of the invention, the connector device resembles a slender rod, several feet long. The device is connected in series with the utility pole guy wire. The lower end of the device is hinged to the ground anchor. The upper end of the device is securely attached to the taught guy wire. When struck by an errant vehicle, the device is pushed out of line with the anchor and utility pole attachment points. The tension in the guy wire increases. A component of the tensile force is applied at a right angle to the axis of the device. The transverse force component creates bending moments which operate to break the device in bending, such that the guy wire is released. The tension in the guy wire causes it to snap away from the vehicle to avoid further damage to the vehicle or its occupants. Following an impact event, a utility crew only needs to replace the failed link to place the guy wire back in service. In a preferred embodiment of the invention, the guy wire system may be rebuilt or repaired with hand tools.

The present invention is superior to prior art designs based on stress concentrations at threads, notches or scored areas. Stress concentration devices are highly dependent on device geometry, surface finish and corrosion. Consequently, stress concentration is an unreliable failure mechanism for use in roadside environments.

Another object of the invention is to provide a failure mechanism that functions only in the event of a side impact. In a preferred embodiment of the invention, failure is caused by mechanical amplification of tensile force on a preloaded rod. The mechanical amplification is a function of component geometry specifically, the device diameter, and overall length. The side impact release mechanism and the ultimate tensile strength of the system are mechanically decoupled, and they can be separately engineered.

In a preferred embodiment of the invention, the releasable device has a higher axial tensile strength than the strongest guy wire in common use, yet the device fails reliably in a side impact with the lightest vehicle under consideration, and is not released by an impact from a slowly moving bicycle or by vandalism. Breakaway devices that rely on weaknesses caused by stress concentration, in contrast, can be separated by tension loading and by side impact loading, and therefore require a separate design for every guy wire strength.

These and other advantages and features of the invention will become apparent from the following detailed description which is provided in conjunction with the accompanying drawings.

DETAILED DESCRIPTION OF PREFERRED EMBODIMENTS

Figure 1:
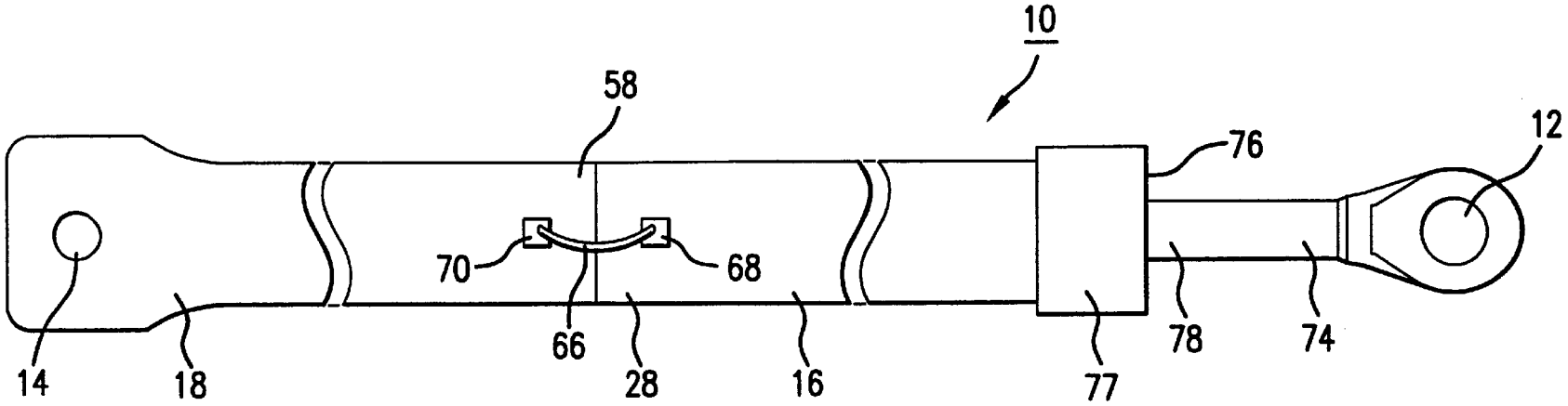
FIG. 1 is a side view of a connector device constructed in accordance with a preferred embodiment of the present invention.
Figure 2:
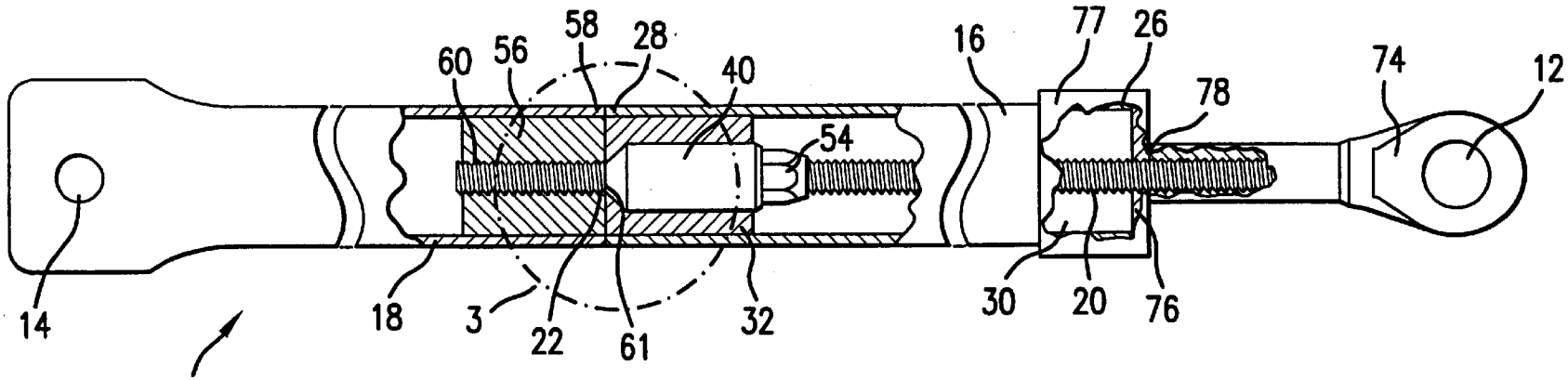
FIG. 2 is a partially broken away side view of the connector device of FIG. 1.
Figure 5:
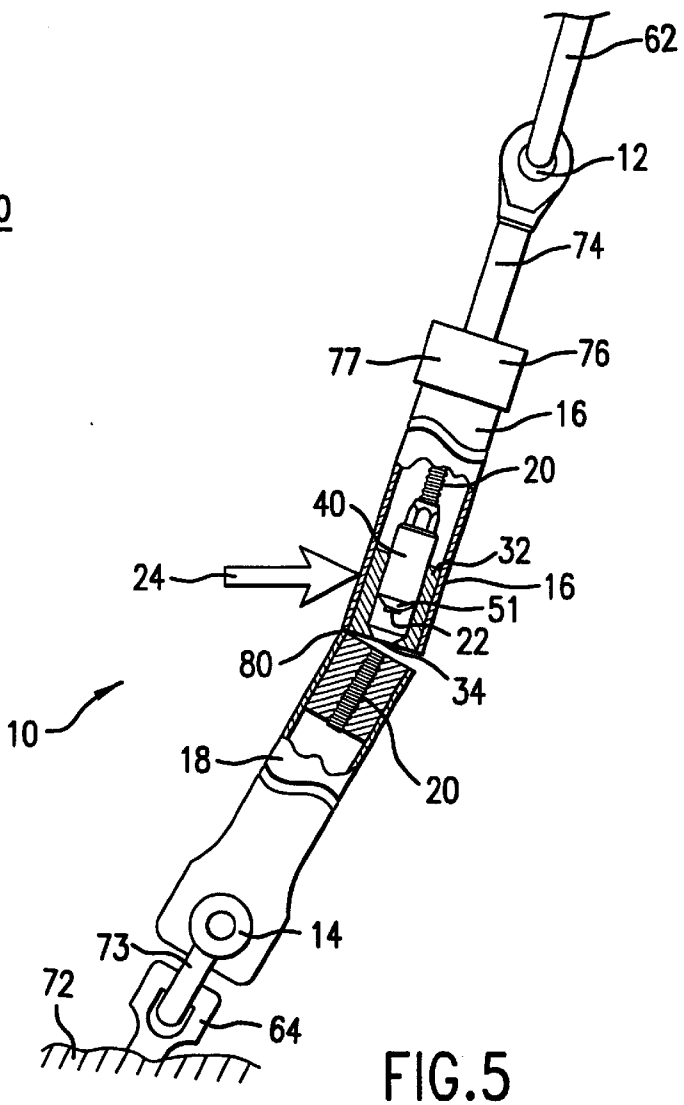
FIG. 5 shows the guy wire system of FIG. 4 at a subsequent stage of operation.
Figure 4:
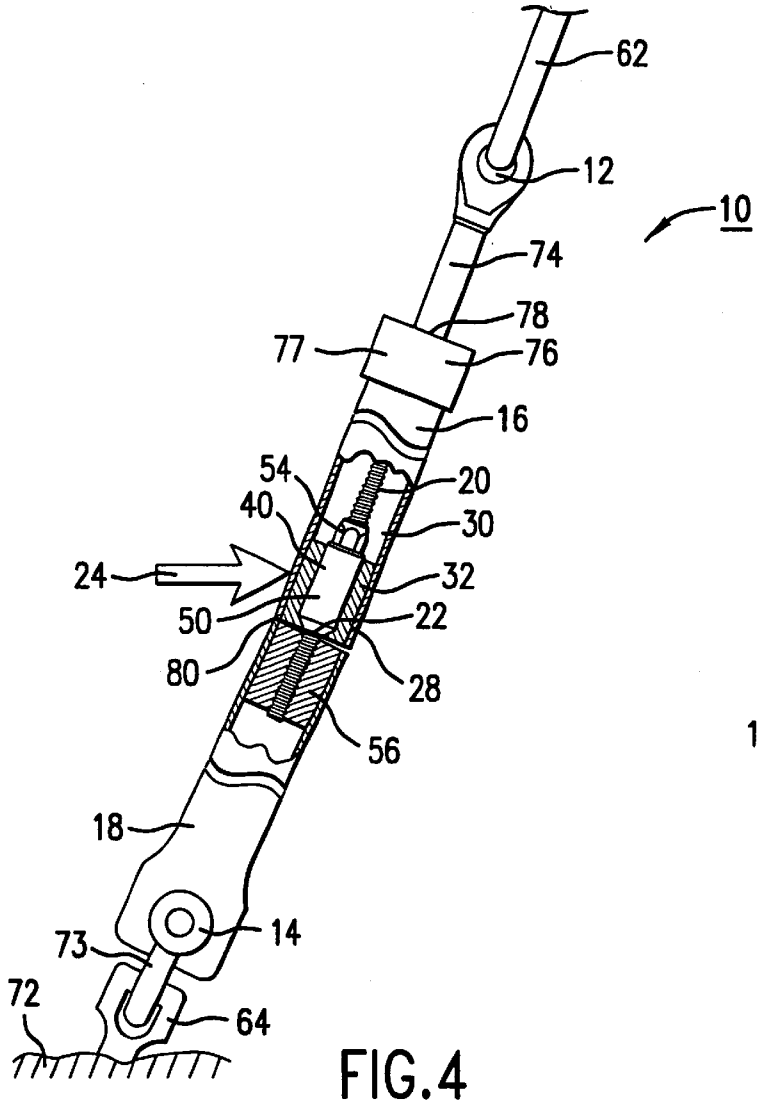
FIG. 4 is a partially broken away side view of the connector device located within a guy wire system.

Referring now to the drawings, where like reference numerals designate like elements, there is shown in FIG. 1 a connector device 10 constructed in accordance with a preferred embodiment of the present invention. The connector device 10 has a top eye 12 for connection to a guy wire and a bottom eye 14 for connection to an anchor device. The guy wire and the anchor device are not shown in FIG. 1. The connector device 10 includes a top tube 16, a bottom tube 18, and a threaded steel rod 20 (FIG. 2). The rod 20 is used to secure the guy wire to the bottom tube 18. In operation, the rod 20 is broken at a break point 22 when the connector device 10 is bent sideways by an impact force 24 (FIGS. 4 and 5).

Figure 3:
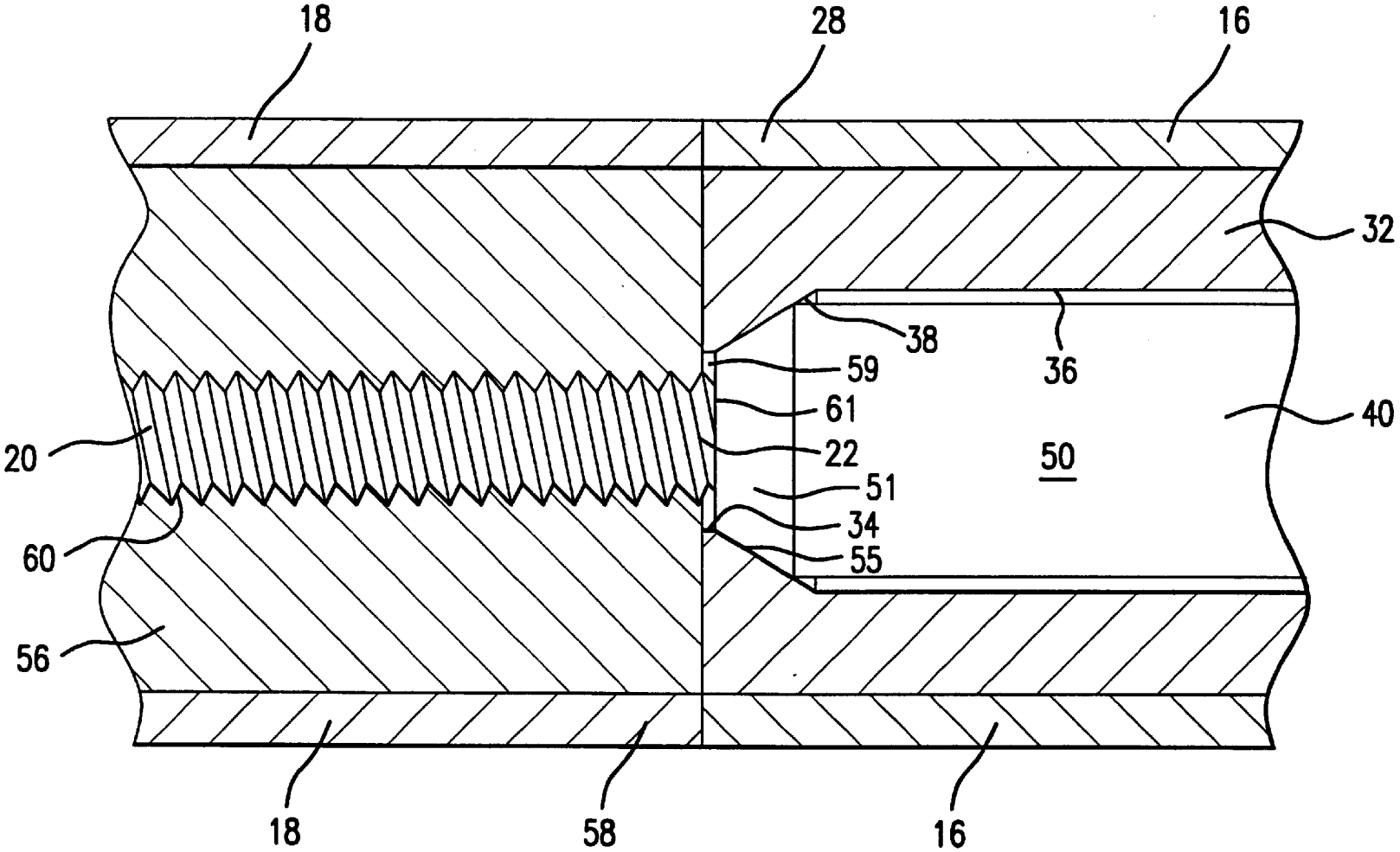
FIG. 3 is an enlarged view of the portion of the connector device designated by circle 3 in FIG. 2.

Referring again to FIG. 2, the top tube 16 may be in the form of a sturdy steel cylinder with opposite ends 26, 28 and a cylindrical interior space 30. A fixture 32 is welded, bolted or otherwise rigidly secured in the top tube 16 near the second end 28. The fixture 32 has a narrow opening 34 (FIG. 3) for receiving the rod 20. The inner diameter of the opening 34 may be slightly greater than the outer diameter of the threaded rod 20. The rod 20 is not threadedly connected to the fixture 32.

In a preferred embodiment, the fixture 32 also has a cylindrical receiving space 36, and a bevel portion 38 that connects the receiving space 36 to the narrow opening 34. Providing the bevel portion 38 adjacent the narrow opening 34 avoids the formation of stress concentrations at the proximal end of the fixture 32.

A threaded cylinder unit 40 is sidably received in the receiving space 36. The unit 40 has a cylindrical exterior surface 50 and a conical surface 51. The outer diameter of the cylindrical surface 50 is slightly less than the inner diameter of the cylindrical receiving space 36. In a preferred embodiment of the invention, the unit 40 has interior threads along its entire length, and those threads are threadedly connected to the threaded rod 20. The threaded cylinder unit 40 may be provided with hexagonal wrench flats 54 for rotating the unit 40 relative to the threaded rod 20, as shown in FIG. 2.

If desired, the entire unit 40 may be machined from a single piece of metal. In the illustrated embodiment, the unit 40 is made of steel. For certain applications, however, the unit 40 may be made of a different material.

The purpose of the cylinder unit 40 is to pull the top and bottom tubes 16, 18 together such that the device 10 operates as a single integral unit. The prestress applied by the unit 40 protects the rod 20 from fatigue stress in the vicinity of the break point 22.

Prior to assembly, the conical surface 55 (FIG. 3) of the bevel portion 38 may diverge outwardly slightly less than the conical surface 51 of the threaded unit 40. This ensures the contact between threaded unit 40 and bevel portion 38 occurs in a region where there is sufficient material to eliminate excessive bending in bevel portion 38 of fixture 32. In addition, it helps minimize the gap 59 between the proximal face 61 of the threaded unit and a bottom fixture 56, such that the rod 20 snaps at the break point 22 in tension and does not undergo excessive elongation before breaking during a side impact collision. The length of the gap 59 may be kept to a minimum to reduce the amount of elongation that occurs in the rod 20 before it breaks. In addition, the bevel portion 38 provides a gradual transition from the thick cylindrical portion of the fixture 32 to the thin edge surrounding the narrow opening 34.

The bottom fixture 56 is rigidly secured within an opening of the bottom tube 18. The bottom fixture 56 may be secured to the bottom tube 18 by a weld (not shown), a bolt or by another suitable connecting structure. The bottom fixture 56 has interior threads 60 that are aligned with the narrow opening 34 of the top fixture 32. The threaded rod 20 is threadedly secured in the bottom fixture 56. In operation, rotation of the threaded cylinder unit 40 causes the conical surface 51 to be forced into the bevel portion 38 of the first fixture 32, such that the rod 20 is placed in tension at the break point 22.

A tool (not shown) may be provided for tightening the threaded unit 40. The tool may have a socket that engages the wrench flats 54, and a head that is driven by hand or by a power tool. An extension may be located between the socket and the head. In operation, the extension extends through the top tube 16 such that the head can be rotated from outside of the tube 16 while the socket is engaged on the wrench flats 54. The tool may be used to tighten the unit 40 to a predetermined torque. Alternatively, the tool may be used to turn the unit 40 a predetermined number of times after it has been hand-tightened on the rod 20.

The tension in the rod 20 is counteracted by compression between the two tubes 16, 18 (or compression between the two fixtures 32, 56 depending on the alignment of the tube ends 28, 58 and the fixtures 32, 56). Thus, the rod 20 is prestressed in tension at the break point 22 before the connector device 10 is installed between the guy wire 62 (FIG. 4) and the anchor device 64. Sufficient prestress tension should be applied to maintain the two tubes 16, 18 pressed together in end to end contact during installation and throughout the life of the device 10 prior to a collision.

In a preferred embodiment of the invention, the threaded components 20, 40, 56 of the connector device 10 are all made of steel. Making all of the connected components of the same metal material reduces the potential for galvanic corrosion. The present invention should not be limited, however, to the preferred embodiments shown and described herein in detail. Corrosion may also be prevented, for example, by providing plastic coatings or others of known art on various components and/or employing a molybdenum disulfide grease as is known in the art.

Referring again to FIG. 1, the rigid steel members 16, 18 may be connected to each other by one or more flexible chains, ropes or cables 66. The ends of the illustrated cable 66 may be attached to the elongated pipes 16, 18 by welds 68, 70 or the like. When the connector device 10 is in its assembled pre-collision configuration (with the ends 28, 58 of the tubes 16, 18 contacting each other as shown in FIG. 1), the length of the cable 66 may be greater than the distance between the welds 68, 70. As shown in FIG. 1, the cable 66 contains slack when the connector device 10 is in its assembled configuration. The slack may be taken up when the rod 20 is broken at the break point 22. The cable 66 operates as an extendable tether to keep the top tube 16 attached to the bottom tube 18 when the rod 20 is broken, as discussed in more detail below.

The anchor device 64 (FIG. 4) may be any suitable device for securing a utility pole guy wire to the ground 72. A shackde 73 may be connected to the anchor device 64 to permit rotation (with at least two degrees of freedom) about mutually orthogonal axes, each perpendicular to the longitudinal axis of the device 10. The shackle 73 may be connected through the bottom eye 14. In operation, the bottom tube 18 may remain firmly connected to the anchor device 64, which remains connected to the ground 72, even in the event of a high speed automotive collision. Thus, according to a preferred mode of operation, the bottom tube 18 remains connected to the ground 72 during a side impact collision.

The distal end of the threaded rod 20 is threaded or welded into an end socket 74. The top eye 12 is located in the distal portion of the end socket 74. The end socket 74 may be used to rigidly connect the threaded rod 20 to the guy wire 62. The guy wire 62 may be a conventional steel wire for securing a utility pole against lateral forces. The tensile strength of the threaded rod 20 at the break point 22 may be greater than the tensile strength of the guy wire 62.

In an alternative embodiment of the invention (not shown in the drawings), the rod 20 is threaded only in the vicinity of the bottom fixture 56, the threaded unit 40 and the end socket 74. The smoother the rod 20, the easier it will slide out of the upper tube 16, and the easier it will be snapped away from the errant automobile by the tension in the guy wire 62.

In a preferred embodiment of the invention, an end cap 76 is located between the proximal end 78 of the end socket 74 and the first end 26 of the top tube 16. The end cap 76 has a cylindrical body portion 77 that slidably overlaps the top tube 16. The end cap 76 may be connected to the end socket 74 and/or the rod 20. The end cap 76 is not connected to the top tube 16. Consequently, when the end socket 74 is pulled away from the top tube 16 (by the guy wire 62), the end cap 76 and the upper portion of the rod 20 remain integrally connected to the end socket 74 and the guy wire 62. As noted above, the distal end of the rod 20 is rigidly secured in the end socket 74.

As shown in FIG. 2, the cylindrical portion 77 of the end cap 76 laps over the outside of the tube 16. The overlapping construction provides superior environmental control over the interior of the tube 16. When the tension in the guy wire 62 is applied, it tends to move the cap 76 slightly away from the distal end 26 of the top tube 16. The movement is caused by the elongation of the rod 20 caused by the tension of the guy wire 62. In the illustrated embodiment, the end cap 76 can move slightly away from the tube 16 and still the body portion 77 overlaps the distal portion 26 of the tube 16.

In addition, the end cap 76 may be used to centralize the rod 20 within the top tube 16. This way, the distal end 26 of the top tube 16 does not have to be moved into side contact with the rod 20 before the desired breaking action occurs at the separation plane (22). In other words, it is helpful to keep the rod 20 stationary with respect to the tube 16 during the initial moments of a collision so that there is no sideways slack in the system 10, 62.

The end cap 76 may be used to seal off the end 26 of the top tube 16. The end cap 76 may prevent ice, water, salt and the like from reaching the interior operative components 40, 22 of the device 10. The end cap 76 may also be used to discourage vandalism and the like by providing a neat, closed construction.

As shown in FIG. 4, the connector device 10 may be sized to receive the impact force 24 of an oncoming automotive vehicle (not shown in FIG. 4). Although FIG. 4 shows the impact force 24 being applied at a location above the separation plane between the two tubes 16, 18, the impact force 24 may be applied at other locations on the connector device 10. The impact force 24 causes the connector device 10 to bend or pivot at a fulcrum point 80. That is, the rigid elements 16, 18 rotate relative to each other about the fulcrum point 80. The fulcrum point 80 is located within the plane between the two tubes 16, 18. During a collision, the applied bending moment stretches the rod 20 (FIG. 4) and eventually breaks the rod 20 at the break point 22 (FIG. 5). The device 10 employs mechanical advantage to amplify the tension in the tension member 20 until it breaks at the break point 22. During the collision, the tension applied to the rod 20 at the break point 22 is greater than the tension in the guy wire 62.

After the break occurs at the break point 22, the tension in the guy wire 62 causes the upper portion of the rod 20 to be snapped upwardly to a location where it is less likely to impact the automobile. That is, when the break occurs, the upper portion of the rod 20 stays with the guy wire 62, and the top tube 16 stays with the bottom tube 18. The cable 66 (FIG. 1) keeps the tubes 16, 18 flexibly connected to each other, which provides advantages as discussed in more detail below in connection with FIGS. 6–9. The guy wire 62 tends to snap upwardly and stay near the utility pole where it is less likely to damage the vehicle or injure its occupants or swing into the normal flow of traffic.

Figure 6:
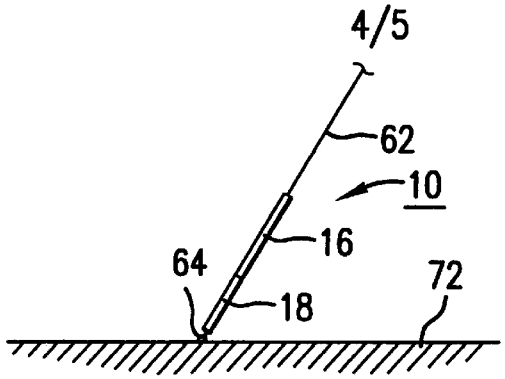
FIGS. 6–9 illustrate the guy wire system of FIGS. 4 and 5 at sequential stages of operation.

FIG. 6 shows the guy wire system 10, 62 in a pre-collision assembled configuration. The guy wire 62 is attached to a utility pole (not illustrated) in a known manner. The anchor device 64 is likewise secured to the ground 72 in a manner known in the art. The guy wire 62 should preferably be installed tight so that no slack needs to be taken up before a release occurs in a collision. In other words, the illustrated connector 10 is preferably installed in a taught guy wire system. The connector device 10 is interposed between the guy wire 62 and the ground attachment device 64. The utility pole may be, for example, a forty foot long wooden telephone pole, and the guy wire 62 may be anchored at a desired angle (for example, sixty degrees) with respect to the ground 72. The present invention should not be limited, however, to the specific structures and instrumentalities shown and described herein.

Figure 7:
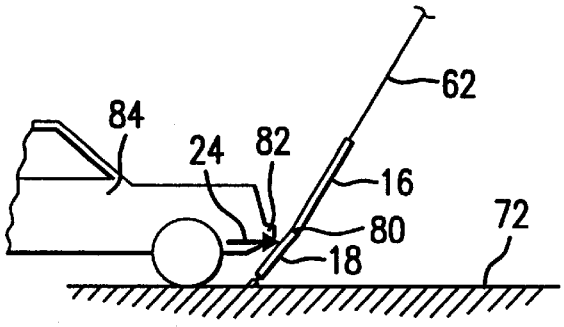
Figure 8:
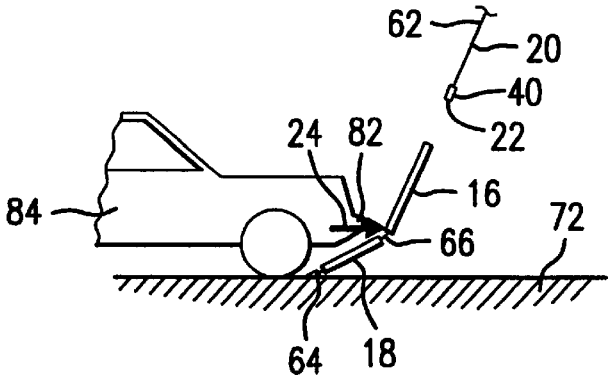

Referring now to FIG. 7, the bumper 82 of an oncoming vehicle 84 applies an impact force to the connector device 10. The vehicle 84 may be an automobile, truck or the like. The impact force 24 causes the two pieces 16, 18 of the connector device 10 to pivot at the fulcrum point 80, such that the rod 20 is broken at the break point 22 (FIG. 8). As the vehicle 84 continues to move through the guy wire system, the top tube 16 may be run over by the vehicle 84. The cable 66 operates as a flexible hinge that extends between the top and bottom tubes 16, 18. The top tube 16 remains attached to the ground 72 via the cable 66, the bottom tube 18, and the anchor device 64 (FIG. 9).

The illustrated arrangement causes the relatively massive top tube 16 to remain near the ground 72, such that the vehicle 84 tends to run over it. The top tube 16 is prevented from flying upward where it could potentially injure the vehicle occupants. The present invention also males it easier to locate the top tube 16 after the collision so that the connector device 10 can be rebuilt with a minimum number of replacement parts. During a collision, the end socket 74 and the end cap 76 remain attached to the guy wire 62. As a result, the end socket 74 and the end cap 76 may be reused in a rebuilt connector device 10. In many cases, the only part that will need to be replaced to rebuild the connector device 10 will be the threaded rod 20.

Referring now to FIGS. 4 and 5, according to a preferred embodiment, the tubes 16, 18 are sufficiently massive to ensure that they are not damaged during a high speed collision. The tubes 16, 18 resist bending such that the connector device 10 separates and pivots at the fulcrum point 80. The tubes 16, 18 should be sufficiently strong and durable to resist degradation by vandalism, weather and the like.

Figure 9:
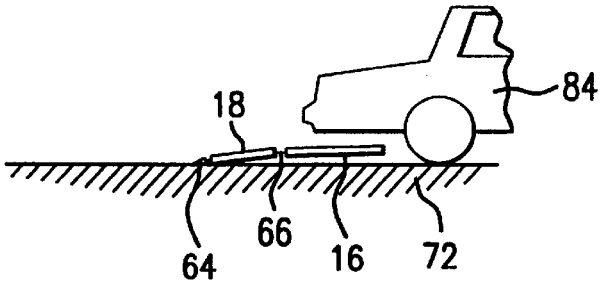

Although the collision shown in FIGS. 7–9 involves the vehicle 84 moving toward the utility pole, the invention should not be limited to that mode of operation. The safety device 10 operates as intended regardless of the direction of movement of the oncoming vehicle 84. When the vehicle 84 is moving away from the pole, the side impact force 24 may be applied somewhat higher up the device 10. In a preferred embodiment of the invention, all of the operative components, including the tubes 16, 18, are axially symmetrical with respect to the central axis of the threaded rod 20. This way, the device 10 fails reliably as intended regardless of the direction of impact.

If desired, a plastic or metal guy wire cover (not shown), of a type known in the art, may be located over the connector device 10.

Figure 10:
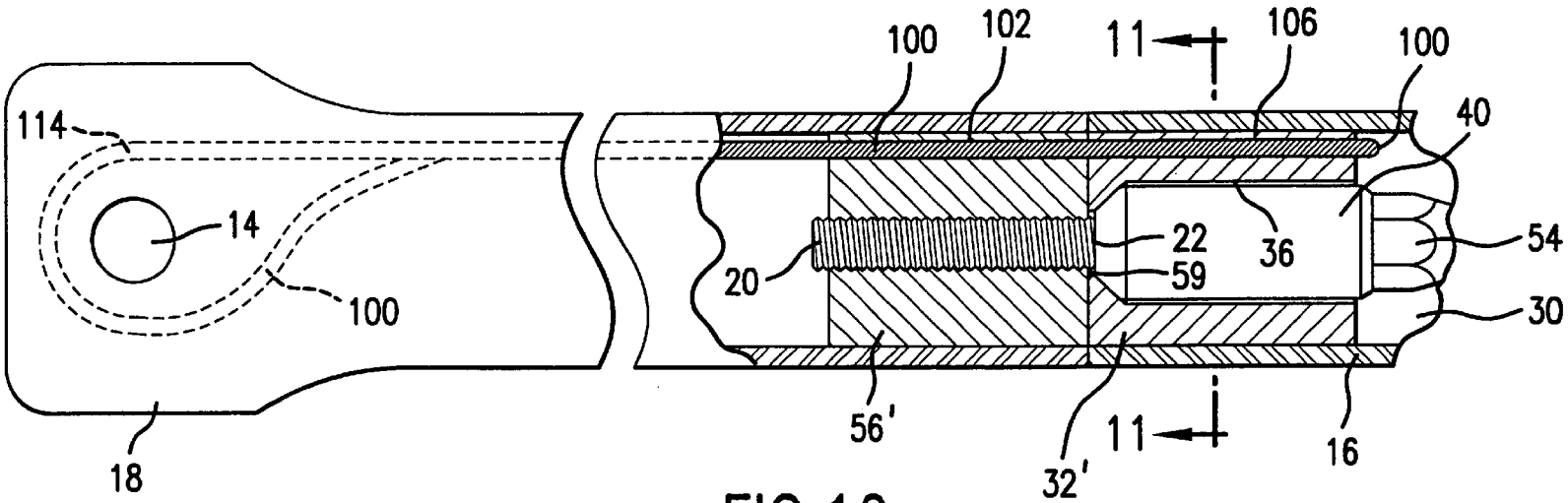
FIG. 10 is a partially broken away side view of a device constructed in accordance with another preferred embodiment of the present invention.
Figure 11:
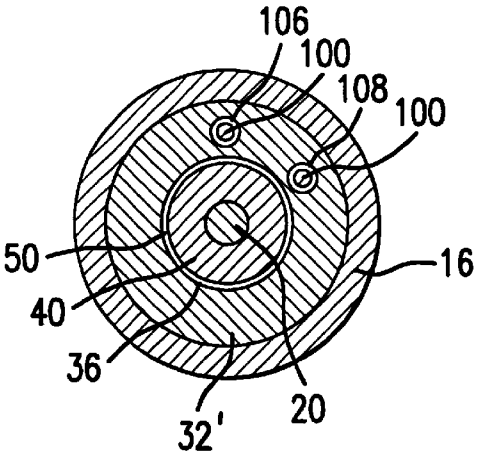
FIG. 11 cross sectional view of the device of FIG. 10, taken along the line 11—11.

Numerous structural and organizational changes may be made to the device 10 without departing from the spirit and scope of the present invention. For example, as shown in FIGS. 10 and 11, a relatively long steel cable 100 may be employed to flexibly secure the top tube 16 to the bottom tube 18. The cable 100 may be employed instead of the cable 66 shown in FIG. 1. The FIG. 10 cable 100 may be inserted through openings 102, 106, 108 in the two fixtures 32', 56'. The cable 100 may form a loop such that it is prevented from passing back through the openings 106, 108 in the top fixture 32'. The middle portion 114 of the cable 100 may be looped around the bottom eye 14. The ends of the cable 100 may be connected to each other by a suitable connection mechanism to form a closed loop. The cable 100 need not be welded or otherwise attached to the bottom tube 18.

The cable 100 is slack in the pre-collision assembled position shown in FIG. 10. When the rod 20 is broken during a collision, the flexible cable 100 prevents the top tube 16 from moving away from the bottom tube 18, although hinged movement between the two tubes 16, 18 is permitted.

Furthermore, the present invention is not limited to use in utility pole guy wire systems. The invention may also be applicable, for example, to triple cable barrier systems. Thus, the invention may be used to prevent a car from becoming wedged under the downstream end of a triple cable barrier system where the cables extend from the last post to a buried anchor.

The invention may also be applicable to a wide variety of other systems. In general, the invention may be used wherever a releasable connector may be employed as part of a tension system that is released by a side impact. The invention may be used, for example, as a shunt for a patient's blood vessel, and for other surgical implants and/or other medical purposes. The invention may also be employed in the rigging of sail boats, such as offshore racing boats, rock climbing equipment, and tethers for space vehicles and other equipment. Under some design thresholds, a releasable connector may be actuated by hitting it on the side to release a sailboat rigging component in the event of an emergency, for example.

Reference has been made to preferred embodiments in describing the invention. However, additions, deletions, substitutions, or other modifications which would fall within the scope of the invention defined in the claims may be implemented by those skilled in the art without departing from the spirit or scope of the invention. Accordingly, the invention is not to be considered as limited by the foregoing description, but is only limited by the scope of the appended claims.

What is claimed as new and desired to be protected by Letters Patent of the United States is:

1. A connector device for providing separation in a side impact collision, said device comprising:

first and second elongated rigid elements; and a tension member located between said rigid elements; and wherein said elongated rigid elements are arranged to pivot relative to each other during said side impact collision, such that tension in said tension member is amplified until said tension member breaks; and wherein said device further comprises a flexible connector for preventing said first rigid element from separating from said second element during said collision.

2. A connector device for providing separation in a side impact collision, said device comprising:

first and second elongated rigid elements; and a tension member located between said rigid elements; and wherein said elongated rigid elements are arranged to pivot relative to each other during said side impact collision, such that tension in said tension member is amplified until said tension member breaks;

wherein said rigid elements include steel pipes, and wherein said tension member is located within said first and second rigid elements;

wherein said device further comprises a threaded unit for applying tension to said tension member, said threaded unit being located within said first rigid element; and wherein said device further comprises a threaded fixture for connection to said tension member, said threaded fixture being located in said second rigid element.

3. The device of claim 2, wherein said threaded unit and at least a portion of said tension member are arranged to slide out of said first rigid element during said collision.

4. A guy wire system, comprising:

a guy wire;

an anchor device for applying tension to said guy wire; and a releasable connector device interposed between said guy wire and said anchor device, and wherein said releasable connector device includes first and second elongated rigid elements in contact with each other at a break point, and a tether for securing said rigid elements together and for keeping said first and second elongated rigid elements together during a collision.

5. The system of claim 4, further comprising a threaded rod for connecting said second rigid element to said guy wire.

6. The system of claim 5, wherein said rod extends through said first rigid element.

7. The system of claim 6, further comprising an end socket for connecting said rod to said guy wire, said end socket being located between said first rigid element and said guy wire.

8. The system of claim 7, wherein said rigid elements define a fulcrum point at a peripheral location where said connector device bends during said collision.

9. The system of claim 8, further comprising a threaded device for applying tension to said threaded rod, said threaded device being located in said first rigid element.

10. A method of operating a guy wire system, wherein said guy wire system includes a connector device and a guy wire, and wherein said method includes the steps of:

providing said connector device and said guy wire;

applying a bending moment to said connector device, and thereby causing a breakable element to break within said connector device;

subsequently, pulling a portion of said breakable element through a first rigid portion of said connector device;

using said guy wire to pull said portion of said breakable element through said first rigid portion of said connector device; and providing an extendable connection between said first rigid portion of said connector device and a second rigid portion of said connector device.

11. The method of claim 10, wherein said bending moment is applied by a moving vehicle.

12. The method of claim 14, wherein said guy wire is attached to said connector device during said step of applying said bending moment.

13. A method of operating a guy wire system, said method including the steps of:

applying a bending moment to a connector device, and thereby causing a breakable element to break within said connector device;

subsequently, using a guy wire to pull a portion of said breakable element through a first rigid portion of said connector device; and providing an extendable connection between said first rigid portion of said connector device and a second rigid portion of said connector device; and wherein said bending moment is applied by a moving vehicle;

wherein said guy wire is attached to said connector device during said step of applying said bending moment; and wherein said method further comprises the step of threading a threaded unit on said breakable element to place said breakable element in tension.

14. The method of claim 13, wherein said threaded unit remains attached to said guy wire during said step of using said guy wire to pull said breakable element through said connector device.

15. The method of claim 10, further comprising the step of anchoring said connector device to the ground.

16. The method of claim 15, further comprising the step of securing said guy wire to a utility pole.

17. A method of making a guy wire system, said method comprising the steps of:

assembling a side impact releasable connector by: locating a threaded rod within a rigid element; extending a tool through said rigid element; and subsequently, rotating said tool to tighten a threaded device on said rod; and connecting said side impact releasable connector to a guy wire.

18. A method of assembling a side impact releasable connector, wherein said side impact releasable connector includes first and second rigid elements, and wherein said method comprises the steps of:

providing a flexible tether between said first and second rigid elements;

locating a threaded rod within said first rigid element;

extending a tool through said first rigid element; and subsequently, rotating said tool to tighten a threaded device on said rod.

* * * * *